US005448216A

United States Patent [19]

Kuze et al.

[11] Patent Number: 5,448,216

[45] Date of Patent: Sep. 5, 1995

[54] FLYBACK TRANSFORMER

[75] Inventors: Yoshikazu Kuze, Katano; Hidekatsu Kajimoto, Neyagawa, both of Japan

[73] Assignee: Matsushita Electric Industrial Co., Ltd., Osaka, Japan

[21] Appl. No.: 236,935

[22] Filed: May 2, 1994

[30] Foreign Application Priority Data

May 7, 1993 [JP] Japan ..... 5-106605

[51] Int. Cl.[6] ..... H01F 27/04; H01F 15/10; H01F 27/30

[52] U.S. Cl. ..... 336/90; 336/98; 336/170; 336/174; 336/192

[58] Field of Search ..... 336/90, 92, 98, 170, 336/174, 175, 185, 192, 107; 324/127

[56] References Cited

U.S. PATENT DOCUMENTS 4,639,706 1/1987 Shimizu ..... 336/192

FOREIGN PATENT DOCUMENTS 61-187307 8/1986 Japan .
62-18012 1/1987 Japan .
157607 3/1989 Japan .

*Primary Examiner*—Thomas J. Kozma
*Attorney, Agent, or Firm*—Panitch Schwarze Jacobs & Nadel

[57] ABSTRACT

A connecting member is fixedly mounted in a predetermined location so as to penetrate a closed space formed with a ferrite core, and an end of a first lead wire is inserted and connected with an engagement part formed at one end part of the connecting member, and an end of a second lead wire is inserted and connected with an engagement part formed at the other end part of the connecting member, thereby, the trigger winding is formed.

9 Claims, 12 Drawing Sheets

FLYBACK TRANSFORMER

FIELD OF INVENTION AND RELATED ART STATEMENT

1. Field of the Invention

This invention relates to a flyback transformer (hereinafter referred to as a FBT) which is to be used in a cathode-ray tube of a television receiver and a display unit or the like.

2. Description of the Prior Art

A conventional FBT will be explained with reference to FIG. 8 and FIG. 9. FIG. 8 is a perspective view showing a conventional FBT. FIG. 9 is a partial cross sectional view taken on line IX—IX in FIG. 8 showing a conventional FBT.

In FIG. 8, the conventional FBT 100 comprises an insulating housing 2 for containing at least a primary winding 16 and a secondary winding 17 as shown in FIG. 9, a ferrite core 3 and a trigger winding 10.

The insulating housing 2 (FIG. 8) is made of an insulating resin such as a denatured poly (phenylene oxide), a denatured poly (phenylene ether) and a poly (butylene terephthalate) and comprises a cover part 2*a* and a body part 2*b*. A focus control handle 21 for adjusting a voltage applied to a focus circuit (not shown) is provided on the cover part 2*a*. A screen control handle 22 for adjusting a voltage applied to a screen circuit (not shown) is provided on the cover part 2*a*. A cylindrical portion 23 is provided on the body part 2*b*, and a high-tension cable 23*a* is connected to the high-tension terminal (not shown) in the cylindrical portion 23.

As shown in FIG. 9, the ferrite core 3 is composed of a first U-shaped part 4 and a second U-shaped part 5, and is installed with an engagement hole 2*c* of the insulating housing 2. Furthermore, the first U-shaped part 4 comprises a first leg portion 4*a*, a second leg portion 4*b* and a link portion 4*c*. And a slot portion 4*d* is formed on the first leg portion 4*a* and on the link portion 4*c*. Similarly, the second U-shaped part 5 is composed of a first leg portion 5*a*, a second leg portion 5*b* and a link portion 5*c*. And a slot portion 5*d* is formed on the first leg portion 5*a* and the link portion 5*c*. Furthermore, a clamping member 131 having a bulge part 131*a* is installed in the two slot parts 4*d* and 5*d*, so as to form a ferrite ring core 3 having the four leg portions 4*a*, 4*b*, 5*a* and 5*b* and having an inner space 3*a*. The clamping member 131 is fixed in the two slot parts 4*d* and 5*d* by an adhesive. An insulation member 32 is disposed between the two second leg portions 4*b* and 5*b*, and serves as an air gap and for an adjustment of abutting faces. Thus, a magnetic circuit is formed by the ferrite core 3.

An example of an electrical circuit of a general FBT will be explained with reference to FIG. 10. FIG. 10 is a circuit diagram of a general FBT. In FIG. 10, parts of the electrical circuit contained in the body part 2*b* are surrounded by an alternate long and short dash line 200, and the trigger winding 10, which is not contained in the body part 2*b*, is surrounded by a broken line 201.

In FIG. 10, low-tension windings are the primary winding 16, an auxiliary winding 19 and the trigger winding 10, and a high-tension winding is the secondary winding 17. The primary winding 16 is connected to other electrical circuit such as a horizontal deflection circuit (not shown). The secondary winding 17 is constituted of five segment coils 171*a*, 171*b*, 171*c*, 171*d* and 171*e* and five diodes 172*a*, 172*b*, 172*c*, 172*d* and 172*e*. In the secondary winding 17, a cathode of the diode 172*a* is connected to an anode of the cathode-ray tube (not shown) via a resistor 180, an anode of the diode 172*a* is connected to one end of the segment coil 171*a*. A cathode of the diode 172*b* is connected to the other end of the segment coil 171*a*, and an anode of the diode 172*b* is connected to one end of the segment coil 172*b*. Similarly, three diodes 172*c*, 172*d* and 172*e* are connected to four segment coils 171*b*, 171*c*, 171*d* and 171*e* in that order as shown in FIG. 10, and the other end of the segment coil 171*e* is grounded. Thus, one end of the secondary winding 17 is connected to the anode of the cathode-ray tube, and the other end of the secondary winding 17 is grounded. Furthermore, a cathode of the diode 172*d* is connected to a focus circuit (not shown) via a resistor 181, a rheostat 182 and a resistor 183, and is connected to a screen circuit (not shown) via a resistor 181, a rheostat 182, a resistor 184, a rheostat 185. One end of the rheostat 185 is grounded via a resistor 186.

When the primary winding 16 is energized from the horizontal deflection circuit, in the secondary winding 17 an induced voltage is generated by a current in the primary winding 16. A voltage applied to the focus circuit is adjusted by adjusting the rheostat 182 with the focus control handle 21 (shown in FIG. 8), and a voltage applied to the screen circuit is adjusted by adjusting the rheostat 185 with the screen control handle 22 (shown in FIG. 8). Furthermore, in the trigger winding 10 a pulse is generated by a current in the primary winding 16.

As shown in FIG. 9, a slot bobbin 2*d* is disposed in the body part 2*b* around the two second leg portions 4*b* and 5*b* of the ferrite core 3, and the primary winding 16 and the auxiliary winding 19 are wound around the slot bobbin 2*d* with a section winding form. Respective both ends of the primary winding 16 and the auxiliary winding 19 are connected to four the low-tension terminals 24. A bobbin 2*e* is disposed in the body part 2*b* around the slot bobbin 2*d*, and the secondary winding 17 is wound around the bobbin 2*e* with a layer winding form such that five segment coils 171*e*, 171*d*, 171*c*, 171*b* and 171*a* are wound in that order. Respective five segment coils 171*a*, 171*b*, 171*c*, 171*d* and 171*e* are wound in FIG. 9 from the upper side downwards, and are disposed between two insulation films 170. One end of the segment coil 171*a* is connected to the high-tension terminal (not shown), and one end of the segment coil 171*e* is grounded in the body part 2*b*. One end of the resistor 186 is grounded via a different low-tension terminal (not shown). An insulating resin 25 is poured into the body part 2*b* in order to insulate the primary winding 16 and the auxiliary winding 19 from the secondary winding 17.

The construction of the trigger winding 10 of the conventional FBT 100 will be explained in the following lines.

In the conventional FBT 100, the trigger winding 10 is formed with a lead wire 110 which is insulator-coated electrical wire such as a polyvinyl chloride wire. Namely, as shown in FIG. 8, the lead wire 110 is wound around the first leg portion 4*a* of the ferrite core 3, and a winding part 110*c* of the lead wire 110 is formed with a predetermined size by a fastening band 111. The winding part 110*c* is held at a predetermined location with the bulge part 131*a* of the clamping member 131 as shown in FIG. 9. This winding part 110*c* substantially forms the trigger winding 10 of the conventional FBT 100. Furthermore, a connecting hardware 50 having a protrusion part 50*a* is caulked to a first and a second end parts 110*a* and 110*b* of the lead wire 110, and is connected to a terminal pin 52*a* of a printed circuit 52 via an insulating tube 51. The protrusion part 50*a* is installed at an engagement part (not shown) in the insulating tube 51 for preventing the rotation and the falling off the lead wire 110 from the terminal pin 52*a*. When the pulse is generated in the lead wire 110, for example, the first end part 110*a* becomes a positive polarity terminal, and the second end part 110*b* becomes a negative polarity terminal. And the pulse is output to the printed circuit 52. A polarity mark 112, which is formed with a paint or a vinyl tube having a property of heat contraction, is provided at near to the first end part 110*a* and the fastening band 111 in order to prevent erroneous connection to the printed circuit 52.

However, the winding part 110*c* of the lead wire 110 and the bulge part 131*a* of the clamping member 131 are required to be a large size in view of the assembly of them. Therefore, in the conventional FBT 100, the location of the winding part 110*c* is changed in the bulge part 131*a*, and there is a problem that an output voltage of the trigger winding 10 is likely to be changed. This undesirable change of the output voltage will be briefly explained with reference to FIG. 11A and FIG. 11B. FIG. 11A is a circuit diagram of a measurement circuit for inspecting the change of the output voltage. FIG. 11B is an explanatory drawing of the location of the winding part 110*c*.

A test used in the measurement circuit was carried out as follows:

(1) The trigger winding 10 is connected to the measurement circuit composed of a diode 190, a capacitor 191 and a resistor 192 as shown in FIG. 11A.

(2) The primary winding 16 is energized such that a predetermined induced voltage is generated in the secondary winding 17.

(3) The location of the winding part 110*c* is changed from a point "A" to a point "B" and a point "C" shown in FIG. 11B.

(4) Voltage across both ends of the resistor 192 is measured by a voltmeter.

The test results are as follows:

(I) A measured voltage at the point "A" is 7.2 V.
(II) A measured voltage at the point "B" is 6.9 V.
(III) A measured voltage at the point "C" is 6.6 V.

Thus, in the conventional FBT 100, the output voltage of the trigger winding 10 has undesirable fluctuation owing to the location of the winding part 110*c* . Furthermore, in the relation between the secondary winding 17 and the trigger winding 10, when the trigger winding 10 is disposed opposite to the most upper part of the secondary winding 17 shown in FIG. 9 and FIG. 10, the output voltage of the trigger winding 10 hardly receives the effect of superimpose by the induced voltage of the secondary winding 17. However, since it is difficult to form the bulge part 131*a* at a position near the link portions 4*c* and 5*c* because of restriction of a die assembly (not shown), the bulge part 131*a* is formed around an intermediate part between two the link portions 4*c* and 5*c*. Therefore, in the conventional FBT 100, there is a problem that an output voltage of the trigger winding 10 is easily superimposed by the induced voltage of the secondary winding 17. More particularly, if an electrical circuit connected with the trigger winding 10 has a high impedance, the output voltage of the trigger winding 10 is further superimposed by the induced voltage of the secondary winding 17. This degree of the superimposition to the output voltage will be briefly explained with reference to FIG. 12A, FIG. 12B and FIG. 12C. FIG. 12A is a circuit diagram of a measurement circuit for inspecting the degree of the superimposition to the output voltage. FIG 12B is an explanatory graph showing the measured range of the output voltage. FIG. 12C is a graph showing the results obtained from the measurement circuit shown in FIG. 12A.

A test used in the measurement circuit was carried out as follows:

(1) One end of the trigger winding 10 is set an open state, and the other end of the trigger winding 10 is grounded via a rheostat 193 as shown in FIG. 12A.

(2) The primary winding 16 is energized such that a predetermined induced voltage is generated in the secondary winding 17.

(3) The resistor value of the rheostat 193 is changed as shown in FIG. 12C.

(4) Voltage of a point "D" shown in FIG. 12A is measured by an oscilloscope. In case the resistor value of the rheostat 193 is between zero Ω and $200\times10^3\Omega$, this measured voltage is equal to the range of "V" shown in FIG. 12B. In case the resistor value of the rheostat 193 is between $1.1\times10^6\Omega$ and $2.2\times10^6\Omega$, this measured voltage is equal to the range of "V'" shown in FIG. 12B.

A broken line 300 shows the result of the measurement in FIG. 12C. As shown in the broken line 300, in the conventional FBT 100, the output voltage of the trigger winding 10 are easily superimposed by the induced voltage of the secondary winding 17.

Furthermore, in the conventional FBT 100, the trigger winding 10 is composed of one lead wire 110 wound around the ferrite core 3. Therefore, the bulge part 131*a* is required to be formed with the clamping member 131 in order to hold the winding part 110*c* of the lead wire 110. Furthermore, there were problems in the assembly of the conventional FBT 100 as follows:

(1) The winding part 110*c* of the lead wire 110 was required to make a temporary tacking with the ferrite core 3 in accordance with a location of the bulge part 131*a* of the clamping member 131. Therefore, it was necessary to use a lot of time and labor.

(2) In assembly work of caulking the connecting hardware 50 with the first and the second end parts 110*a* and 110*b*, it was difficult that two connecting hardware 50 was caulked at the same time. Therefore, it was necessary to use a lot of time and labor.

(3) The polarity mark 112 was required to provide near the first end part 110*a* and the fastening band 111 in order to prevent making a mistake of the connection to the printed circuit 52. Therefore, it was necessary to use a lot of time and labor.

(4) Since the clamping member 131 was fixed with the ferrite core 3 by the adhesive, it was substantially impossible that the length of the lead wire 110 changed after the assembly of the conventional FBT 100 finished. Therefore, the number of kinds of the conventional FBT 100 was increased by the only difference of the length of the lead wire 110. Thereby, various assembly members were required to prepare according to the number of kinds of the conventional FBT 100.

In the conventional FBT 100, there was a problem that it was difficult to achieve an automatic assembly because of the above-mentioned problems.

OBJECT AND SUMMARY OF THE INVENTION

The object of the present invention is to provide a flyback transformer that can solve the aforementioned problems.

In order to achieve the above object, a flyback transformer in accordance with the present invention comprises:

an insulating housing for containing at least a primary winding and a secondary winding, a ferrite core having a first U-shaped part and a second U-shaped part, the ferrite core is installed with an engagement hole of the insulating housing, the first U-shaped part is disposed on the second U-shaped part in a manner to form a ferrite ring core having an inner space, the primary winding and the secondary winding is wound on linking the ferrite core in a manner passing the inner space, a connecting member fixedly mounted in a predetermined location in a manner passing the inner space and having connection means at both end parts, a first lead wire having a first end part, the first end part of the first lead wire being inserted and connected to the connection means formed at one end part of the connecting member, and a second lead wire having a first end part, the first end part of the second lead wire being inserted and connected to the connection means formed at the other end part of the connecting member, whereby the connecting member, the first end part of the first lead wire and the first end part of the second lead wire constitutes a trigger winding.

In the flyback transformer of the present invention, since the connecting member, which comprises the trigger winding, is fixedly mounted in a predetermined location so as to pass the inner space formed by the ferrite core, a location of the trigger winding is fixed with regard to a location of the second winding. Therefore, an output voltage of the trigger winding does not change. Furthermore, the trigger winding is composed of the connecting member, the first end part of the first lead wire and the first end part of the second lead wire. The first end part of the first lead wire is inserted and connected to the connection means formed at one end part of the connecting member, the first end part of the second lead wire is inserted and connected to the connection means formed at the other end part of the connecting member. Therefore, it is possible that an assembly of the trigger winding is made easily and speedy.

BRIEF DESCRIPTION OF THE DRAWINGS

FIG. 4 is a partial cross sectional view taken on line IV—IV in FIG. 3 showing the insulation case used in the flyback transformer of the first embodiment of the present invention after the connecting member is connected with two lead wires in the insulation case.

FIG. 8 is a perspective view showing a conventional flyback transformer.

DESCRIPTION OF THE PREFERRED EMBODIMENTS

Hereafter, preferred embodiments of a flyback transformer of the present invention are described with reference to the accompanying drawings.

<<FIRST EXAMPLE>>

Figure 1:
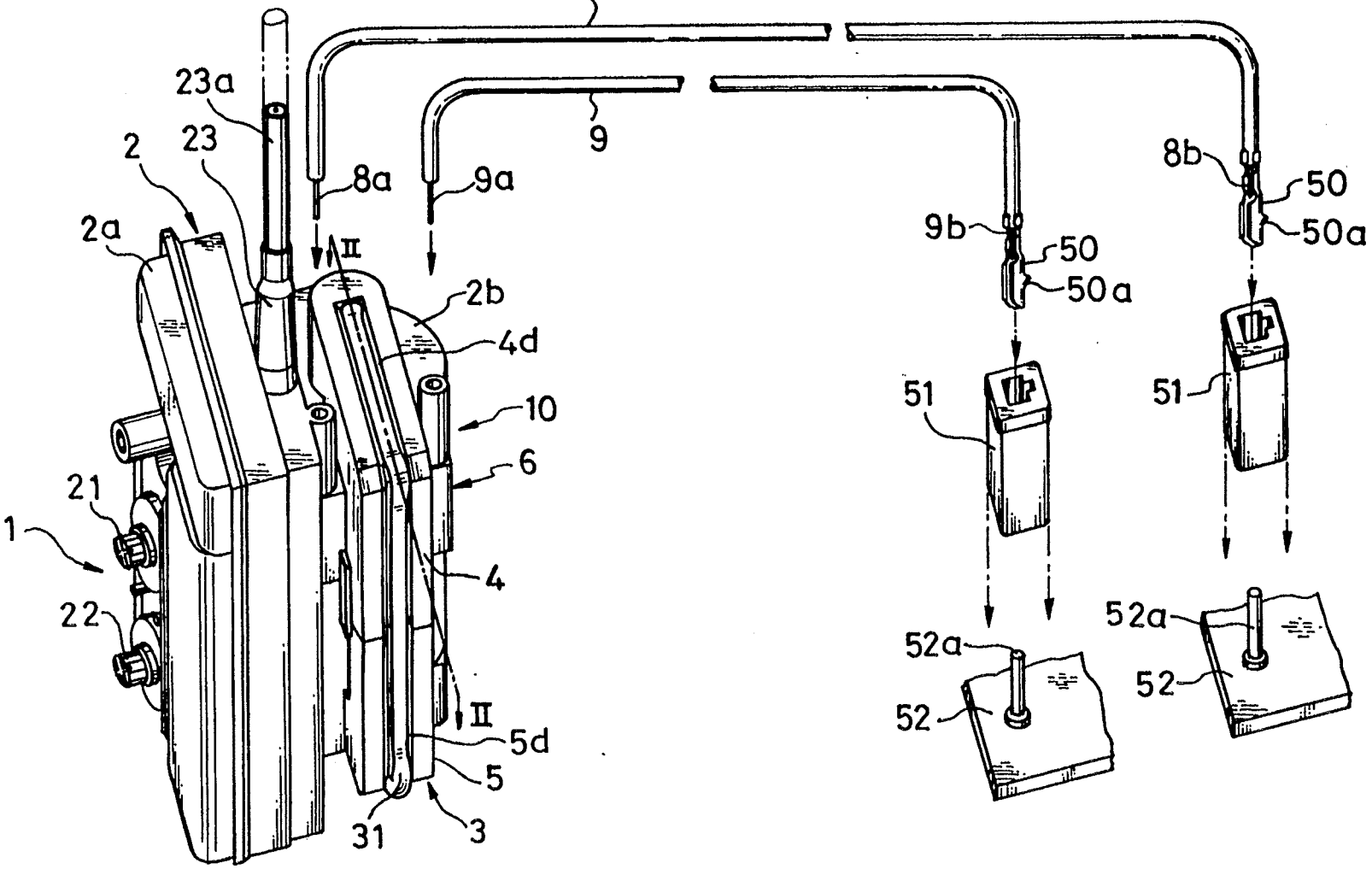
FIG. 1 is a perspective view showing a flyback transformer of a first embodiment of the present invention.
Figure 2:
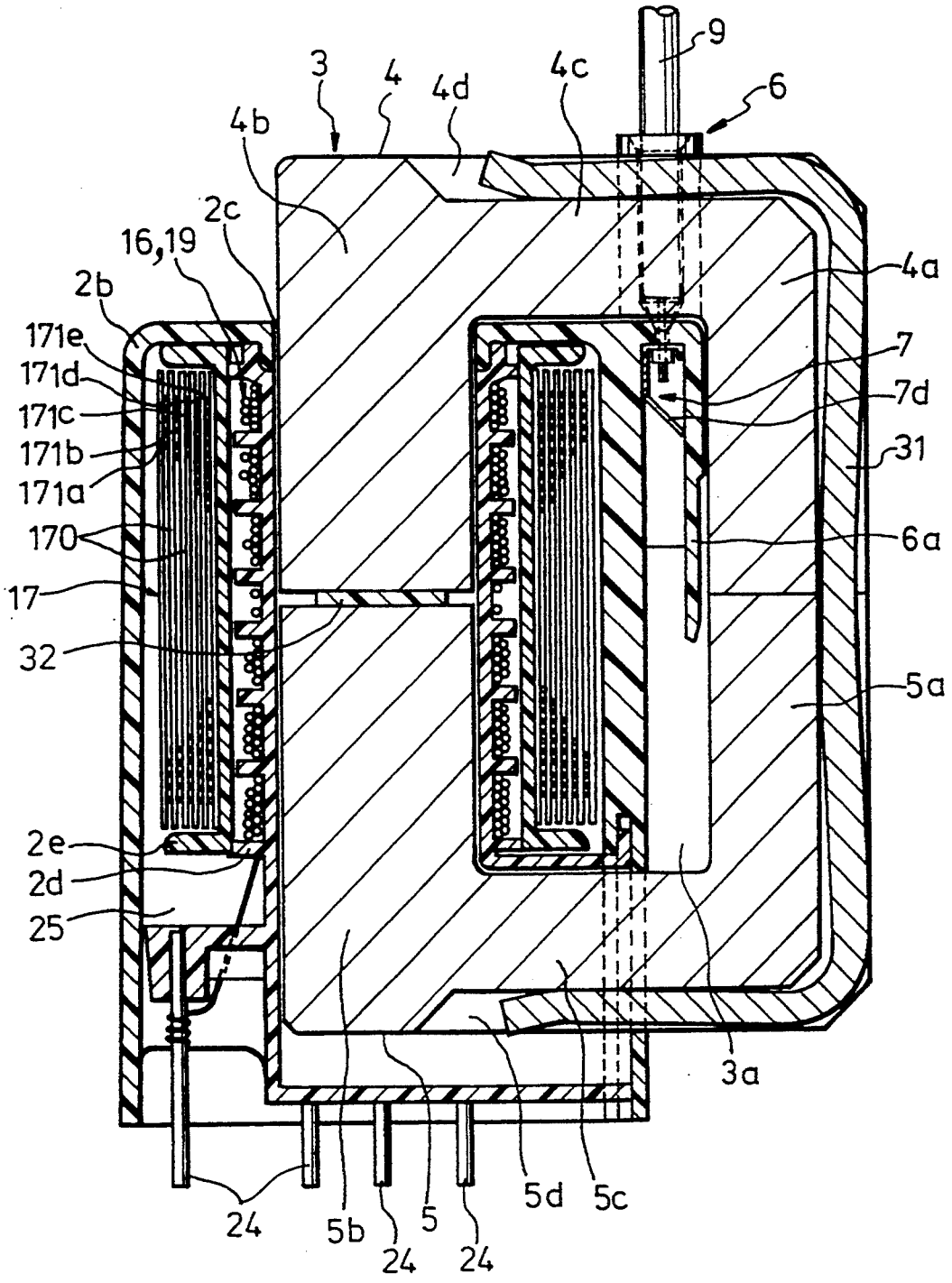
FIG. 2 is a partial cross sectional view taken on line II—II in FIG. 1 showing the flyback transformer of the first embodiment the present invention.

A flyback transformer (hereinafter referred to as a FBT) of the present invention will be explained with reference to FIG. 1 and FIG. 2. FIG. 1 is a perspective view showing a flyback transformer of a first embodiment of the present invention. FIG. 2 is a partial cross sectional view taken on line II—II in FIG. 1 showing the flyback transformer of the first embodiment of the present invention.

In FIG. 1, the FBT 1 in accordance with the present invention comprises an insulating housing 2 for containing at least a primary winding 16 and a secondary winding 17 as shown in FIG. 2, a ferrite core 3 and a trigger winding 10.

The insulating housing 2 is made of an insulating resin such as a denatured poly (phenylene oxide), a denatured poly (phenylene ether) and a poly (butylene terephthalate) and comprises a cover part 2*a* and a body part 2*b*. A focus control handle 21 for adjusting a voltage applied to a focus circuit (not shown) is provided on the cover part 2*a*. A screen control handle 22 for adjusting a voltage applied to a screen circuit (not shown) is provided on the cover part 2*a*. A cylindrical portion 23 is provided on the body part 2*b*, and a high-tension cable 23*a* is connected to the high-tension terminal (not shown) in the cylindrical portion 23.

As shown in FIG. 2, the ferrite core 3 is composed of a first U-shaped part 4 and a second U-shaped part 5, and is installed with an engagement hole 2*c* of the insulating housing 2. Furthermore, the first U-shaped part 4 comprises a first leg portion 4*a*, a second leg portion 4*b* and a link portion 4*c*. And a slot portion 4*d* is formed on the first leg portion 4*a* and on the link portion 4*c*. Similarly, the second U-shaped part 5 is composed of a first leg portion 5*a*, a second leg portion 5*b* and a link portion 5*c*. And a slot portion 5*d* is formed on the first leg portion 5*a* and on the link portion 5*c*. Furthermore, a clamping member 31 is installed in two slot parts 4*d* and 5*d* so as to form a ferrite ring core 3 having four leg portions 4*a*, 4*b* , 5*a* and 5*b* and having an inner space 3*a*. The clamping member 31 is fixed in-two slot parts 4*d* and 5*d* by an adhesive. An insulation member 32 is disposed between two second leg portions 4*b* and 5*b*, and serves as an air gap and for adjustment of abutting faces. Thus, a magnetic circuit is formed by the ferrite core 3.

Figure 10:
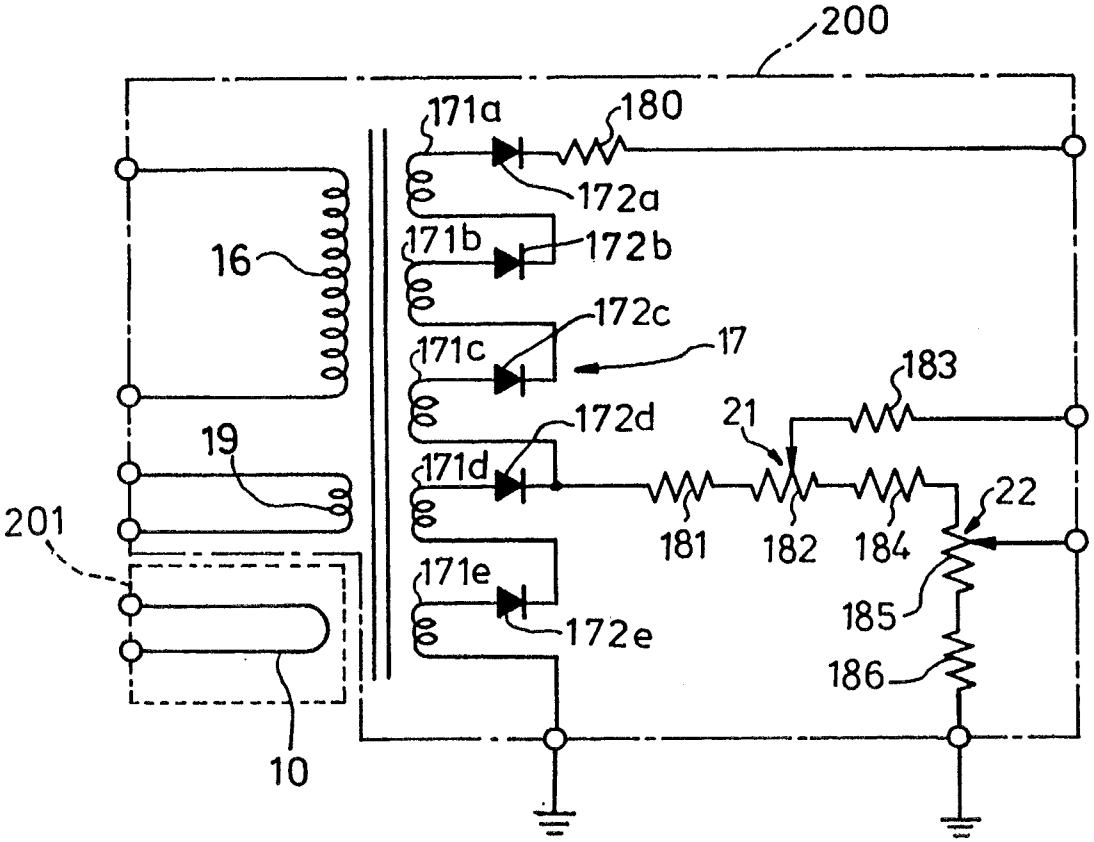
FIG. 10 is a circuit diagram of a general FBT.

An example of an electrical circuit of a general FBT will be explained with reference to FIG. 10. FIG. 10 is a circuit diagram of a general FBT. In FIG. 10, parts of the electrical circuit contained in the body part 2*b* is surrounded by an alternate long and short dash line 200, and the trigger winding 10, which is not contained in the body part 2*b*, is surrounded by a broken line 201.

In FIG. 10, low-tension windings are the primary winding 16, an auxiliary winding 19 and the trigger winding 10, and a high-tension winding is the secondary winding 17. The primary winding 16 is connected to other electrical circuit such as a horizontal deflection circuit (not shown). The secondary winding 17 is constituted of five segment coils 171*a*, 171*b*, 171*c*, 171*d* and 171*e* and five diodes 172*a*, 172*b*, 172*c* , 172*d* and 172*e*. In the secondary winding 17, a cathode of the diode 172*a* is connected to an anode of the cathode-ray tube (not shown) via a resistor 180, an anode of the diode 172*a* is connected to one end of the segment coil 171*a*. A cathode of the diode 172*b* is connected to the other end of the segment coil 171*a*, and an anode of the diode 172*b* is connected to one end of the segment coil 172*b* . Similarly, three diodes 172*c* , 172*d* and 172*e* are connected to four segment coils 171*b*, 171*c*, 171*d* and 171*e* in that order as shown in FIG. 10, and the other end of the segment coil 171*e* is grounded. Thus, one end of the secondary winding 17 is connected to the anode of the cathode-ray tube, and the other end of the secondary winding 17 is grounded. Furthermore, a cathode of the diode 172*d* is connected to a focus circuit (not shown) via a resistor 181, a rheostat 182 and a resistor 183, and is connected with a screen circuit (not shown) via a resistor 181, a rheostat 182, a resistor 184, a rheostat 185. One end of the rheostat 185 is grounded via a resistor 186. An insulating resin 25 is poured into the body part 2*b* in order to insulate the primary winding 16 and the auxiliary winding 19 from the secondary winding 17.

When the primary winding 16 is energized from the horizontal deflection circuit, in the secondary winding 17 an induced voltage is generated by a current in the primary winding 16. A voltage applied to the focus circuit is adjusted by adjusting the rheostat 182 with the focus control handle 21 (shown in FIG. 1), and a voltage applied to the screen circuit is adjusted by adjusting the rheostat 185 with the screen control handle 22 (shown in FIG. 1). Furthermore, in the trigger winding 10 a pulse is generated by a current in the primary winding 16.

As shown in FIG. 2, a slot bobbin 2*d* is disposed in the body part 2*b* around the two second leg portions 4*b* and 5*b* of the ferrite core 3, and the primary winding 16 and the auxiliary winding 19 are wound around the slot bobbin 2*d* with a section winding form. Respective both ends of the primary winding 16 and the auxiliary winding 19 are connected to four low-tension terminals 24. A bobbin 2*e* is disposed in the body part 2*b* around the slot bobbin 2*d*, and the secondary winding 17 is wound around the bobbin 2*e* with a layer winding form such that five segment coils 171*e*, 171*d*, 171*c*, 171*b* and 171*a* are wound in that order. Respective five segment coils 171*a*, 171*b*, 171*c*, 171*d* and 171*e* are wound in FIG. 2 from the upper side downwards, and are disposed between two insulation films 170. One end of the segment coil 171*a* is connected to the high-tension terminal (not shown), and one end of the segment coil 171*e* is grounded in the body part 2*b* . One end of the resistor 186 is grounded via a different low-tension terminal (not shown).

Figure 3:
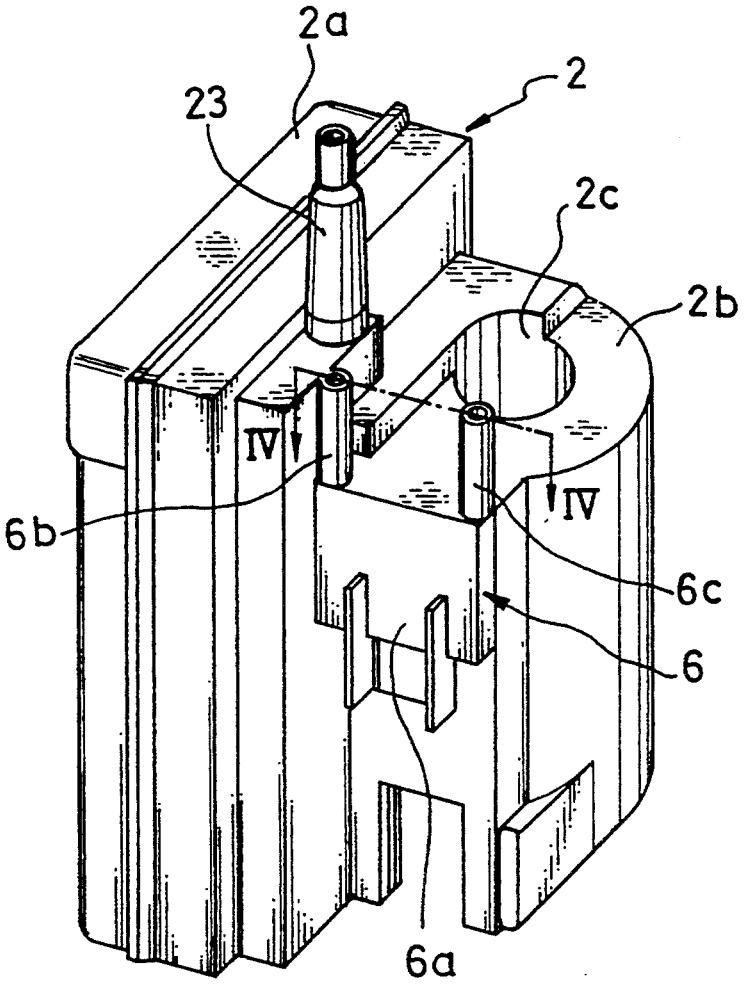
Figure 4A:
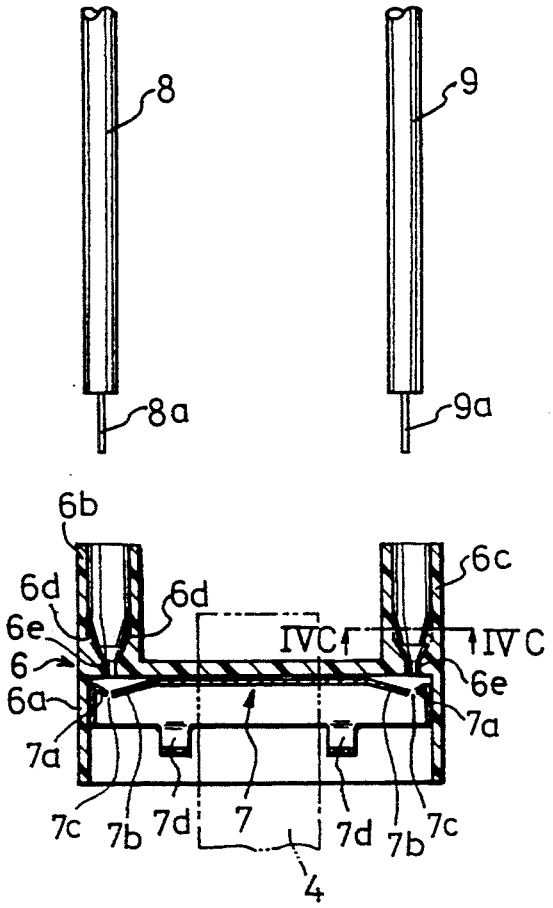
FIG. 4 is a partial cross sectional view taken on line IV—IV in FIG. 3 showing the insulation case used in the flyback transformer of the first embodiment of the present invention before a connecting member is connected with two lead wires in the insulation case.
FIG. 4C is a cross sectional view taken on line IV-C—IVC in FIG. 4A showing a cylindrical part of the insulation case used in the flyback transformer of the first embodiment of the present invention.
Figure 4B:
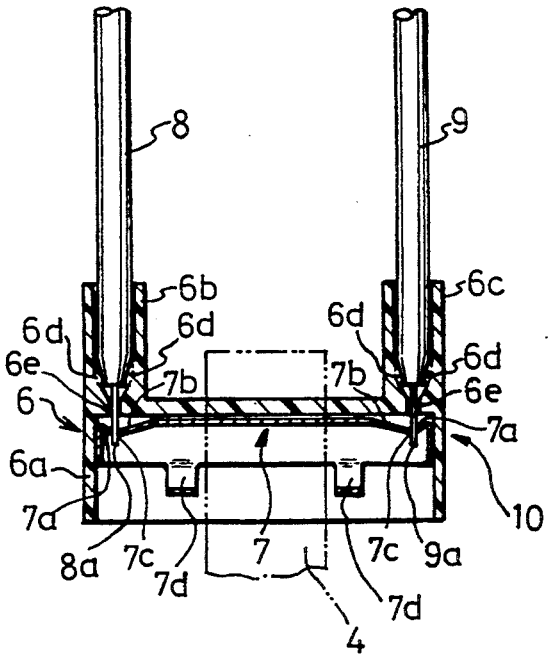
Figure 4C:
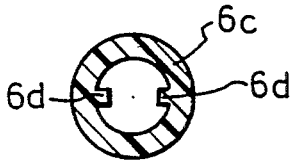
Figure 5:
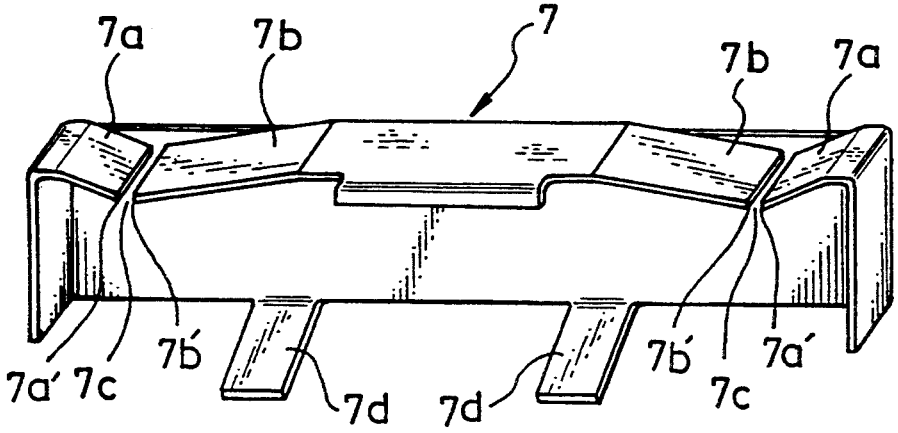
FIG. 5 is a perspective view showing a connecting member used in the flyback transformer of the first embodiment of the present invention.

The construction of the trigger winding 10 of the FBT 1 in accordance with the present invention will be explained with reference to FIG. 3, FIG. 4A, FIG. 4B, FIG. 4C and FIG. 5. FIG. 3 is a perspective view showing an insulation case and an insulating housing used in the flyback transformer of the first embodiment of the present invention. FIG. 4A is a partial cross sectional view taken on line IV—IV in FIG. 3 showing the insulation case used in the flyback transformer of the first embodiment of the present invention before a connecting member is connected with two lead wires in the insulation case. FIG. 4B is a partial cross sectional view taken on line IV—IV in FIG. 3 showing the insulation case used in the flyback transformer of the first embodiment of the present invention after the connecting member is connected with two lead wires in the insulation case. FIG. 4C is a cross sectional view taken on line IVC—IVC in FIG. 4A showing a cylindrical part of the insulation case used in the flyback transformer of the first embodiment of the present invention. FIG. 5 is a perspective view showing a connecting member used in the flyback transformer of the first embodiment of the present invention.

The trigger winding 10 is constituted with a connecting member 7, a first end part 8*a* of a first lead wire 8 and a first end part 9*a* of a second lead wire 9.

As shown in FIG. 5, the connecting member 7 has a first tongue plate 7*a* and a second tongue plate 7*b* at both end parts, and two stopper plates 7*d* at the intermediate part. The first tongue plate 7*a* is disposed on opposite side to the second tongue plate 7*b* so as to form an engagement part 7*c*. The first tongue plate 7*a*, the second tongue plate 7*b* and the engagement part 7*c* form a connecting means. The connecting member 7 is inserted into the below-mentioned box part 6*a* of an insulation case 6 in FIG. 2 from the lower side upwards. As shown in FIG. 2, the connecting member 7 is fixedly mounted in a predetermined location by two stopper plates 7*d* so as to pass the inner space 3*a*. Namely, both end parts of the stopper plate 7*d* come in contact with the inside wall of the box part 6*a*, and two stopper plates 7*d* serve as a holding means of the connecting member 7. The end edges 7*a*'and 7*b*'of two tongue plates 7*a* and 7*b* are formed as sharp knife edge type edges, so as to securely grasp the below-mentioned first end parts 8*a* and 9*a* of first and second lead wires 8 and 9.

As shown in FIG. 3, the insulation case 6 comprises the box part 6a, a first cylindrical part 6b, and a second cylindrical part 6c, and is integrally disposed with the insulating housing 2. The first cylindrical part 6b forms a first introduction means. The second cylindrical part 6c forms a second introduction means. The first cylindrical part 6b is disposed on one end part of the box part 6a, and the second cylindrical part 6c is disposed on the other end part of the box part 6a. Furthermore, as shown in FIG. 4A and FIG. 4B, a through hole 6e is provided between the box part 6a and the first cylindrical part 6b so as to guide the first end part 8a of the first lead wire 8 to the engagement part 7c. Similarly, a through hole 6e is provided between the box part 6a and the second cylindrical part 6c so as to guide the first end part 9a of the second lead wire 9 to the engagement part 7c. As shown in FIG. 4C, two projection parts 6d are provided on the inside wall of the second cylindrical part 6c such that each of two projection parts 6d is tilted tapered toward the center axis of the second cylindrical part 6c downward the through hole 6e so as to form a key to bit an insulation sheath of the two lead wires 8 and 9 to be put therein. These two projection parts 6d are disposed on opposite side with each other in the inside wall of the second cylindrical part 6c. Similarly, two projection parts 6d are provided on the inside wall of the first cylindrical part 6b.

The first and second lead wires 8 and 9 are insulator-coated electrical wire such as a polyvinyl chloride wire. As shown in FIG. 4B, the first lead wire 8 is inserted into the first cylindrical part 6b, and the first end part 8a is inserted in and connected to the engagement part 7c via the through hole 6e. A diameter of the first end part 8a is larger than a width of the engagement part 7c which is equal to a distance between the first tongue plate 7a and the second tongue plate 7b. Therefore, the first end part 8a is securely connected to the first and the second tongue plates 7a and 7b.

Furthermore, in the first cylindrical part 6b, two projection parts 6d are bites a coating of the first lead wire 8. Therefore, the first lead wire 8 is caught and does not rotate around its axis in the first cylindrical part 6b, regardless of the diameter of the first lead wire 8.

As shown in FIG. 1, a conventional connecting hardware 50 having a protrusion part 50a is caulked to a second (the other) end part 8b of the first lead wire 8, and is connected to a terminal pin 52a of a printed circuit 52 via an insulating tube 51. The protrusion part 50a is installed at an engagement part (not shown) in the insulating tube 51 for preventing the rotation and the falling off the first lead wire 8 from the terminal pin 52a.

It is obvious that the connection means 7a, 7b and 7c (FIG. 5) of the present invention have a sample construction compared with the above-mentioned connection using the conventional connecting hardware 50 shown in FIG. 1. Namely, in the connection means 7a, 7b and 7c of the present invention, the connection between the lead wire and the connection member is achieved only by inserting the end part of the lead wire into the connecting member. On the other hand, in the above-mentioned connection using the conventional connecting hardware 50, it is necessary to caulk the connecting hardware 50 to the end part of the lead wire.

Similarly, the second lead wire 9 is inserted into the second cylindrical part 6c, and the first end part 9a is inserted in and connected to the engagement part 7c via the through hole 6e. A diameter of the first end part 9a is larger than a width of the engagement part 7c which is equal to a distance between the first tongue plate 7a and the second tongue plate 7b. Therefore, the first end part 9a is securely connected to the first and the second tongue plates 7a and 7b.

Furthermore, in the second cylindrical part 6c, two projection parts 6d are bites a coating of the second lead wire 9. Therefore, the second lead wire 9 is caught and does not rotate around its axis in the second cylindrical part 6c, regardless of the diameter of the first lead wire 9.

As shown in FIG. 1, the conventional connecting hardware 50 having the protrusion part 50a is caulked to a second (the other) end part 9b of the second lead wire 9, and is connected to the terminal pin 52a of the printed circuit 52 via the insulating tube 51. The protrusion part 50a is installed at the engagement part (not shown) in the insulating tube 51 for preventing the rotation and the falling off the second lead wire 9 from the terminal pin 52a.

As is explained in the aforementioned explanation, the trigger winding 10 of the present invention is constituted with the connecting member 7, the first end part 8a of the first lead-wire 8 and the first end part 9a of the second lead wire 9. When the pulse is generated in the trigger winding 10, for example, the second end part 8b of the first lead wire 8 becomes a positive polarity terminal, and the second end part 9b of the second lead wire 9 becomes a negative polarity terminal. And the pulse is output to the printed circuit 52.

Figure 11A:
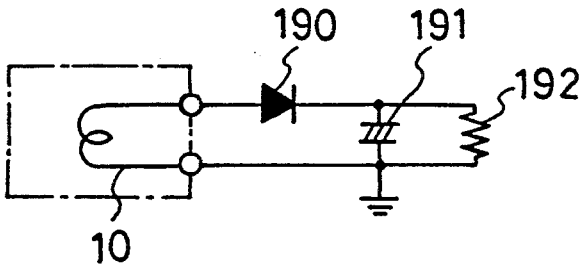
FIG. 11A is a circuit diagram of a measurement circuit for inspecting the change of the output voltage.
Figure 11B:
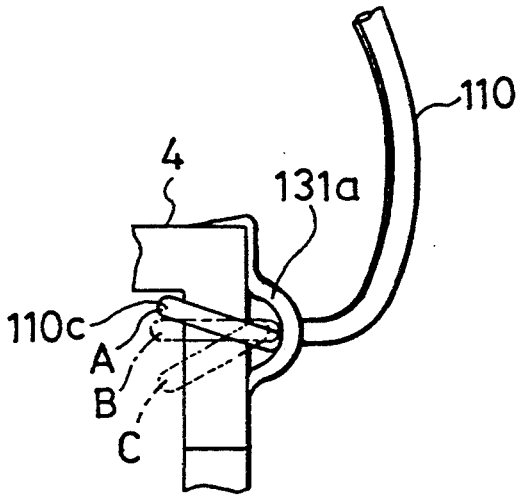
FIG. 11B is an explanatory drawing of the location of the winding part used in the conventional flyback transformer.

Since the connecting member 7 is fixedly mounted in the predetermined location as shown in FIG. 2, FIG. 4A and FIG. 4B, the location of the trigger winding 10 becomes fixed stable in relation to the location of the secondary winding 17. Therefore, the output voltage of the trigger winding 10 does not change. In order to compare with the prior art, the test of the FBT 1 was carried out by the same way as the prior art. The result of the test made by using the measurement circuit shown in FIG. 11A was shown. And the test result shows that a measured voltage is 7.3 V.

Figure 12A:
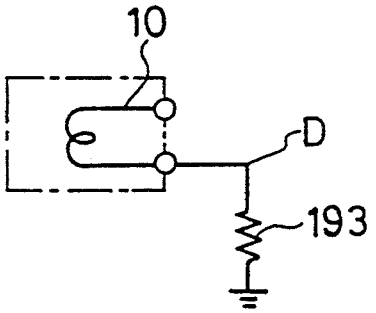
FIG. 12A is a circuit diagram of a measurement circuit for inspecting the degree of the superimposition to the output voltage.
Figure 12B:
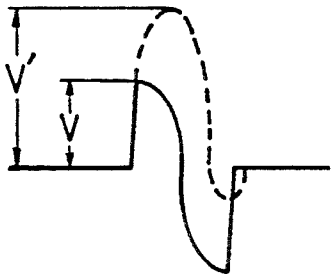
FIG. 12B is an explanatory graph showing the measured range of the output voltage.
Figure 12C:
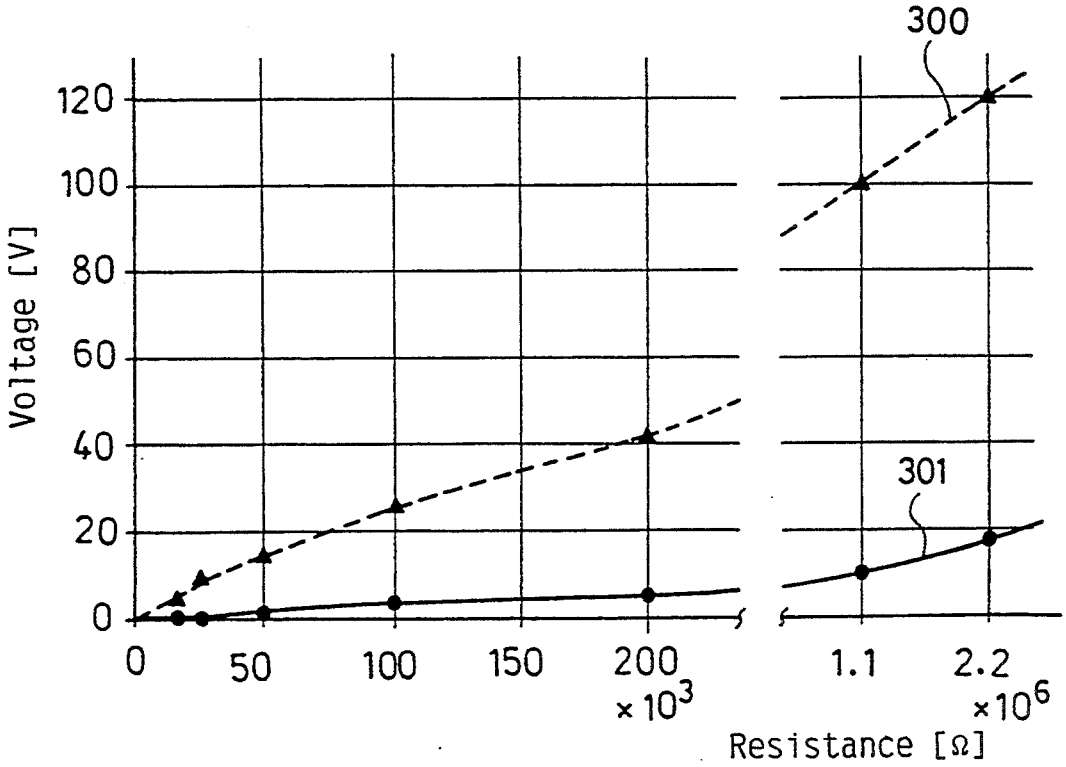
FIG. 12C is a graph showing the results obtained from the measurement circuit shown in FIG. 12A.

Needless to say, the connecting member 7 is fixedly mounted in such predetermined location that the influence by the induced voltage of the secondary winding 17 to the output voltage of the trigger winding 10 is negligibly small. In order to compare with the prior art, the test of the FBT 1 was carried out by the same way as the prior art. The result of the test, in which the measurement circuit shown in FIG. 12A was used, is shown by a solid line 301 of FIG. 12C. As shown in the solid line 301, the degree of the superimposition of effect by the induced voltage of the secondary winding 17 to the output voltage is smaller than that of the prior art.

Since two lead wires 8 and 9 are used in the trigger winding 10, the FBT 1 of the present invention has the advantages as follows:

(1) In caulking of the connecting hardware 50 to two second end parts 8b and 9b in assembly work, it is possible to caulk both ends 8b and 9b at the same time, by setting both lead wires 8 and 9, whose other ends are not yet inserted into the first and second cylindrical parts 6b and 6c for connection to the connecting member 7, to a caulking machine. Two connecting hardware 50 can be made in one caulking motion before caulked at the same time.

(2) In case a color of the first lead wire 8 differs from a color of the second lead wire 9 with each other, a polarity mark, which is provided in the prior art, is not required.

Furthermore, in the present invention, the assembly of the trigger winding 10 is such that two first end parts 8*a* and 9*a* are inserted into and connected to the connecting member 7 which is fixedly mounted in the predetermined location. Therefore, the FBT 1 of the present invention has further advantages as follows:

(3) The bulge part 131*a* used in the prior art is not required for the clamping member 31.

(4) The first and the second lead wires 8 and 9 used in the prior art for temporarily tacking them to the ferrite core 3 are not required.

(5) In the prior art, after caulking the connecting hardware 50 to both end parts 110*a* and 110*b* of the lead wire 110 formed into loop-shape by the fastening band 111, the length of the lead wire 110 was fixed and non-selectable or non-adjustable. In the present invention, it is possible to select various lengths of the lead wire having the connecting hardware 50 at one end part corresponding to the uses of the FBT. Therefore, it is possible to be free from the problems that the lead wire length is excessively long or short with regard to the necessary connection length.

In the FBT 1 of the present invention, there are the above-mentioned advantages, and an automatic assembly is easily achieved. <A MODIFIED VERSION OF THE FIRST EXAMPLE>

Figure 6:
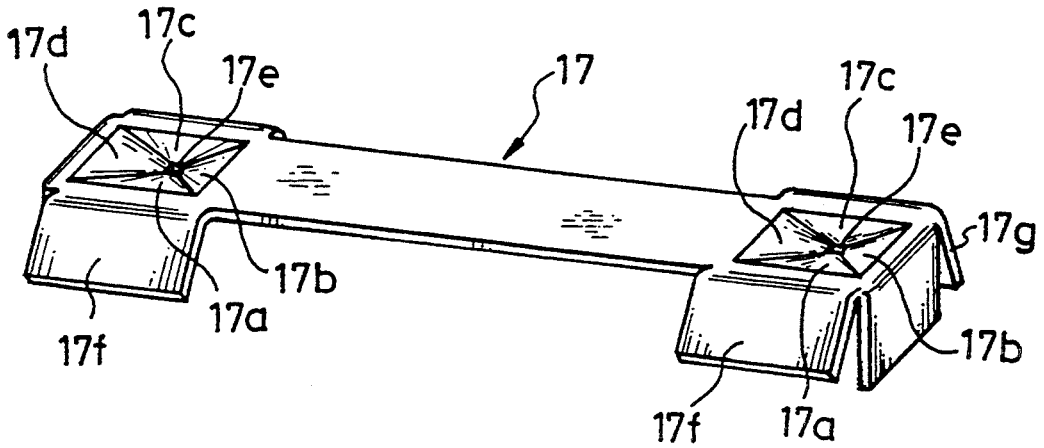
FIG. 6 is a perspective view showing a modified version of the connecting member used in the flyback transformer of the first embodiment of the present invention.
Figure 7B:
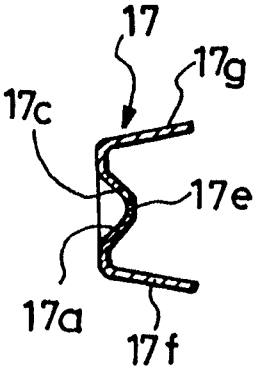
FIG. 7B is cross sectional view taken on line VIIB—VIIB in FIG. 7A showing the connecting member.
Figure 7A:
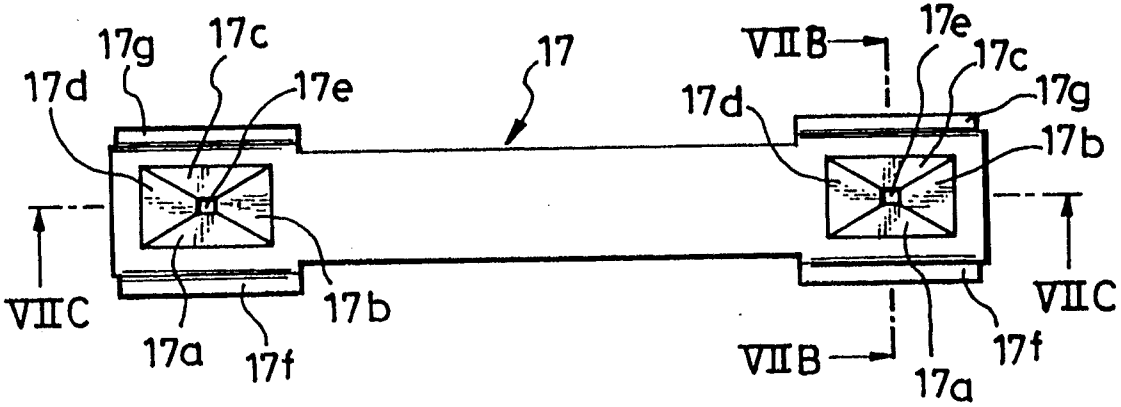
FIG. 7A is a top plan view of the connecting member shown in FIG. 6.
Figure 7C:
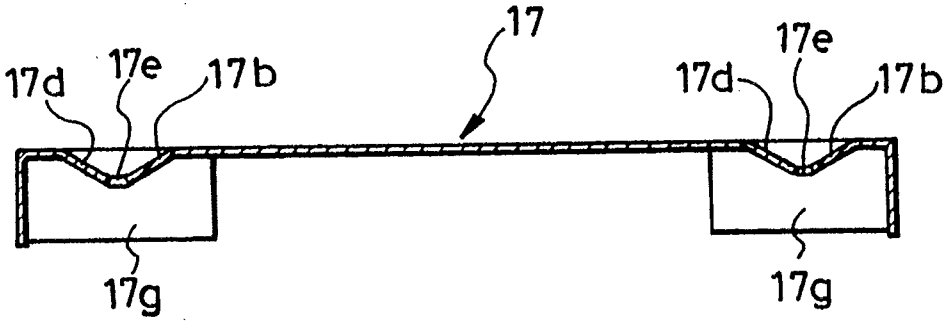
FIG. 7C is cross sectional view taken on line VIIC—VIIC in FIG. 7A showing the connecting member.
Figure 8:
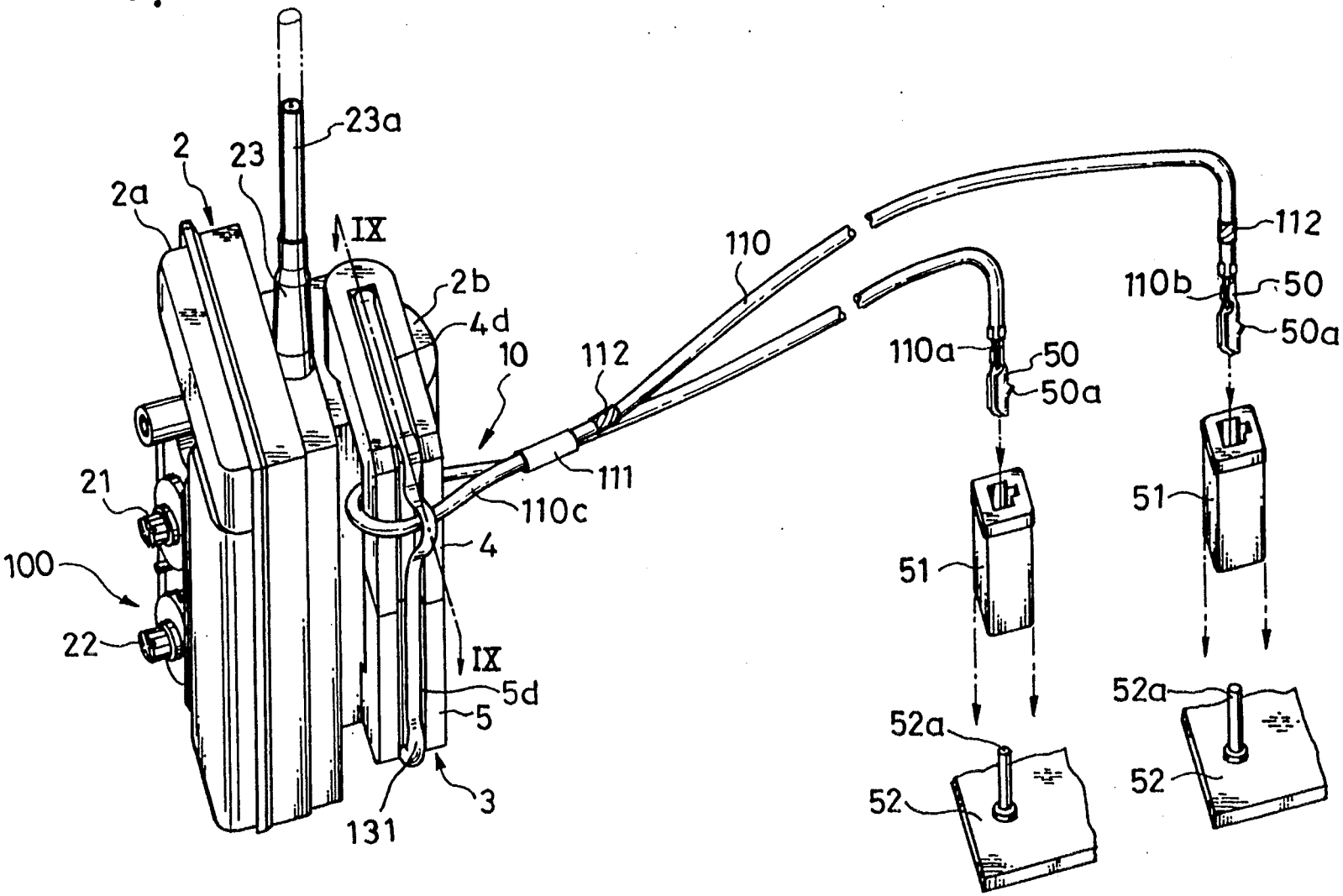
FIG. 8 is a perspective view showing an insulation case and an insulating housing used in the flyback transformer of the first embodiment of the present invention.
Figure 9:
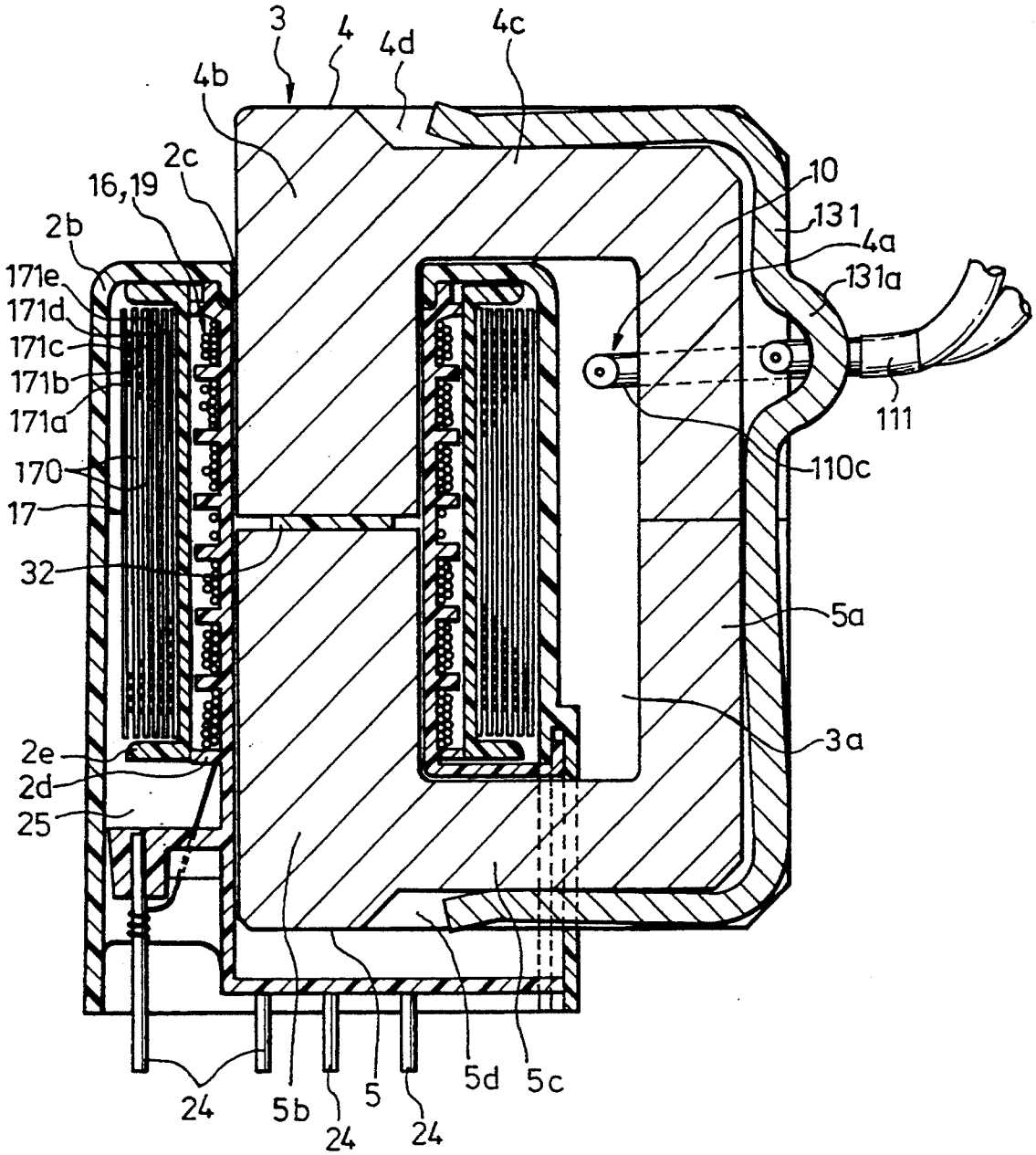
FIG. 9 is a partial cross sectional view taken on line IX—IX in FIG. 8 showing the conventional flyback transformer.

A modified version of the first example will be explained with reference to FIG. 6, FIG. 7A, FIG. 7B and FIG. 7C. FIG. 6 is a perspective view showing a modified version of the connecting member used in the flyback transformer of the first embodiment of the present invention. FIG. 7A is a top plan view of the connecting member shown in FIG. 6. FIG. 7B is cross sectional view taken on line VIIB—VIIB in FIG. 7A showing the connecting member. FIG. 7C is cross sectional view taken on line VIIC—VIIC in FIG. 7A showing the connecting member. In this modified version, the same components and parts as those of the first embodiment are designated by the same numerals and the corresponding descriptions similarly apply. Therefore, the descriptions will be made mainly on the modified parts from the first embodiment.

In FIG. 6, the connecting member 17 has a first tongue plate 17*a*, a second tongue plate 17*b*, a third tongue plate 17*c* and a fourth tongue plate 17*e* at both end parts. Furthermore, the connecting member 17 has a first stopper plate 17*f* and a second stopper plate 17*g* at both end parts.

As shown in FIG. 7A, FIG. 7B and FIG. 7C, the first tongue plate 17*a* is disposed on opposite side to the third tongue plate 17*c*, and the second tongue plate 17*b* is disposed on opposite side to the fourth tongue plate 17*d*. An engagement hole 17*e* is formed by end edges of four tongue plates 17*a*, 17*b*, 17*c* and 17*d*. A size of the engagement hole 17*e* is smaller than the diameter of two first end parts 8*a* and 9*a*. Therefore, two first end parts 8*a* and 9*a* are securely connected to four tongue plates 17*a*, 17*b*, 17*c* and 17*d*. In this modified version, connecting means are constituted of four tongue plates 17*a*, 17*b*, 17*c* and 17*d* and the engagement hole 17*e*.

The first stopper plate 17*f* is disposed on opposite side to the second stopper plate 17*g*. When the connecting member 17 is inserted into the box part 6*a* of an insulation case 6 in FIG. 2 from the lower side upwards, the connecting member 17 is fixedly mounted in a predetermined location by the pairs of the first and the second stopper plates 17*f* and 17*g* so as to pass the inner space 3*a*. Namely, both end parts of the first and the second stopper plates 17*f* and 17*g* come in contact with the inside wall of the box part 6*a*, and the pairs of the first and the second stopper plates 17*f* and 17*g* serve as a holding means of the connecting member 17.

In this modified version, the end part of the lead wire is inserted into the engagement hole 17*e*, and connected to by being caught by the end tips of the four tongue plates 17*a*, 17*b*, 17*c* and 17*d*. Therefore, the end part of the lead wire is more tightly connected as compared with that of the first embodiment. Furthermore, since the pairs of the first and the second stopper plates 17*f* and 17*g* serve as a holding means of the connecting member 17, the connecting member 17 is more fixedly mounted as compared with that of the first embodiment.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. A flyback transformer comprising:

an insulating housing for containing at least a primary winding and a secondary winding, a ferrite core having a first U-shaped part and a second U-shaped part, said ferrite core being installed with an engagement hole of said insulating housing, said first U-shaped part being disposed on said second U-shaped part in a manner to form a ferrite core having an inner space, said primary winding and said secondary winding being wound on and linking said ferrite core in a manner passing said inner space, a connecting member fixedly mounted in a predetermined location in a manner passing said inner space and having connection means at both end parts, a first lead wire having a first end part, said first end part of said first lead wire being inserted into and connected to said connection means formed at one end part of said connecting member, and a second lead wire having a first end part, said first end part of said second lead wire being inserted into and connected to said connection means formed at said other end part of said connecting member, whereby said connecting member, said first end part of said first lead wire and said first end part of said second lead wire constitutes a trigger winding.

2. A flyback transformer in accordance with claim 1, further comprising:

an insulation case having a box part, a first introduction means and a second introduction means, said insulation case being integrally disposed with said insulating housing, said box part containing said connecting member, said first introduction means containing at least said first end part of said first lead wire, said second introduction means containing at least said first end part of said second lead wire.

3. A flyback transformer in accordance with claim 1, wherein said connection means has a first tongue plate and a second tongue plate, said first tongue plate being disposed on opposite side to said second tongue plate in a manner to form an engagement part.

4. A flyback transformer in accordance with claim 1, wherein said connection means has a first tongue plate, a second tongue plate, a third tongue plate and a fourth tongue plate, said first tongue plate being disposed on opposite side to said third tongue plate, said second tongue plate being disposed on opposite side to said fourth tongue plate, said first tongue plate, said second tongue plate, said third tongue plate and said fourth tongue plate together forming an engagement part.

5. A flyback transformer in accordance with claim 1, wherein said connecting member has a first stopper plate and a second stopper plate at both end parts, said first stopper plate being disposed on opposite side to said second stopper plate.

6. A flyback transformer in accordance with claim 2, wherein said first and said second introduction means has cylindrical-shape part which further comprises a projection part on the inside wall, said projection part being tilted to the center axis of said first and said second introduction means.

7. A flyback transformer in accordance with claim 2, wherein said connection means has a first tongue plate and a second tongue plate, said first tongue plate being disposed on opposite side to said second tongue plate in a manner to form an engagement part.

8. A flyback transformer in accordance with claim 2, wherein said connection means has a first tongue plate, a second tongue plate, a third tongue plate and a fourth tongue plate, said first tongue plate being disposed on opposite side to said third tongue plate, said second tongue plate being disposed on opposite side to said fourth tongue plate, said first tongue plate, said second tongue plate, said third tongue plate and said fourth tongue plate together forming an engagement part.

9. A flyback transformer in accordance with claim 2, wherein said connecting member has a first stopper plate and a second stopper plate at both end parts, said first stopper plate being disposed on opposite side to said second stopper plate.

* * * * *